US009021973B2

(12) United States Patent
Smith

(10) Patent No.: US 9,021,973 B2
(45) Date of Patent: May 5, 2015

(54) BUOYANCY ENHANCING DRINK HOLDER FOR USE WITH A FLOATING RECREATIONAL BOARD

(71) Applicant: Fraser Smith, St. Pete Beach, FL (US)

(72) Inventor: Fraser Smith, St. Pete Beach, FL (US)

( * ) Notice: Subject to any disclaimer, the term of this patent is extended or adjusted under 35 U.S.C. 154(b) by 154 days.

(21) Appl. No.: 13/923,433

(22) Filed: Jun. 21, 2013

(65) Prior Publication Data

US 2014/0004762 A1 Jan. 2, 2014

Related U.S. Application Data

(60) Provisional application No. 61/666,800, filed on Jun. 30, 2012.

(51) Int. Cl.

| | |
|---|---|
| ***B63B 43/14*** | (2006.01) |
| ***B63B 35/85*** | (2006.01) |
| ***B63B 35/79*** | (2006.01) |
| ***B63B 43/02*** | (2006.01) |
| *A47G 23/02* | (2006.01) |
| *B63B 59/02* | (2006.01) |

(52) U.S. Cl.

CPC ..... *B63B 35/85* (2013.01); *Y10T 29/49716* (2015.01); *A47G 23/02* (2013.01); *B63B 35/7933* (2013.01); *B63B 43/02* (2013.01); *B63B 43/14* (2013.01); *B63B 59/02* (2013.01); *A47G 2200/02* (2013.01)

(58) Field of Classification Search

USPC ..... 114/123
IPC ..... B63B 43/14
See application file for complete search history.

(56) References Cited

U.S. PATENT DOCUMENTS

| | | | | |
|---|---|---|---|---|
| 4,287,624 | A * | 9/1981 | Lowther | 114/343 |
| 4,926,774 | A * | 5/1990 | Winner | 114/123 |
| 5,000,106 | A * | 3/1991 | Rheney | 114/66 |
| 5,411,425 | A * | 5/1995 | Rinker | 441/130 |
| 6,041,727 | A * | 3/2000 | Yamada et al. | 114/123 |

* cited by examiner

*Primary Examiner* — Stephen Avila
(74) *Attorney, Agent, or Firm* — Carla Gannon Law

(57) ABSTRACT

A flotation system for a recreational board such as a stand up paddleboard includes an elongated substrate that is sized and shaped to releaseably wrap around the perimeter of a recreational board. The elongated substrate is constructed of a buoyant material such as foam, and defines a plurality of apertures that can be used to store items such as beverages and personal belongings. The elongated substrate is releaseably attached to the board by a variety of fastening means, and serves to increase stability and buoyancy of the board, and to protect the board.

16 Claims, 5 Drawing Sheets

BUOYANCY ENHANCING DRINK HOLDER FOR USE WITH A FLOATING RECREATIONAL BOARD

RELATED APPLICATIONS

This application claims the benefit of U.S. Provisional Patent Application 61/666,800, filed Jun. 30, 2012.

BACKGROUND OF THE INVENTION

1. Field of the Invention

The present invention relates to enhancement systems for floating recreational boards such as paddleboards and surfboards. More specifically, the invention relates to a device which attaches to a recreational board and improves flotation, can be used to hold beverages and other items, and protects the edges of a recreational board.

2. Description of the Prior Art

Stand-up paddleboards ("SUPs") are gaining in popularity for a variety of reasons including recreation, exercise, ease in learning, and short-distance transportation. However, traditional SUPs have certain limitations. For one, not everyone is coordinated enough to maintain their balance on a SUP, especially where the water is turbulent from waves, water movement, wakes, and so forth. As a result, a paddler may fall off their board. Another limitation is that a conventional SUP doesn't provide a compartment or other place to secure personal belongings such as keys, wallets, and beverage containers. As a result, the paddler must keep these items on their person, which can be uncomfortable. If the paddler falls off the board, which can happen frequently, items will be submerged in water, and possibly lost. Thus, it would be advantageous to provide a device that increased the overall stability of a SUP, and provided storage.

While SUPs have conventionally been used for actual stand up paddleboarding, some use SUP's as a congregation point for people enjoying aquatic activities, for example a floating bar of sorts. In this manner one or more people drape their arms over the top surface of the SUP to provide flotation. However, the buoyancy of the SUP is decreased as people weigh down the SUP. In addition, just as people paddleboarding lack a compartment where they can store their belongings, people congregating around a SUP lack a secure place for their belongings. Thus, it would be advantageous to provide a device that increased the overall buoyancy of a SUP, and provided storage.

SUPs are designed to be strong, yet light. However, as they are intended for use in water, they are prone to dings, abrasions, and other damage. The likelihood of this damage is increased because SUPs are large and somewhat cumbersome. Thus, it would be advantageous to protect the perimeter of the SUP to increase longevity of use.

As can be seen, there is a need for a flotation device that increases the overall stability and buoyancy of a recreational board, while providing storage for beverages and other personal items. It is also desirable that a flotation device would afford protection to the recreational board. Further, it is also desirable for the flotation device to be lightweight, inexpensive and easy to manufacture. It is also desirable that the flotation device can be easily attached and removed.

SUMMARY OF THE INVENTION

A flotation system includes an elongated substrate that is sized and shaped to releaseably wrap around the perimeter of a recreational board. The elongated substrate is constructed of a buoyant material such as foam, and defines a plurality of apertures that can be used to store items such as beverages and personal belongings. The elongated substrate is releaseably attached to the board by a variety of fastening means including a sheath having webbing and buckles, or ropes or elastomeric ropes that essentially tie the substrate to the board.

DETAILED DESCRIPTION OF PREFERRED EMBODIMENTS

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

The following numbers apply to structures among the various FIGS:

10—Flotation system;
11—Elongated substrate;
12—Top portion;
13—Cup holder;
14—Longitudinal channel;
15—Side portion;
16—Bottom portion;
17—Cupholder insert;
18—Slot;
20—Recreational board;
22—Planar top
23—Planar bottom
24—Perimeter
30—Fastening member;
31—Sheath;
32—Channel;
33—Channel sleeve;
34—Belts; and
35—Buckles.

Figure 1:
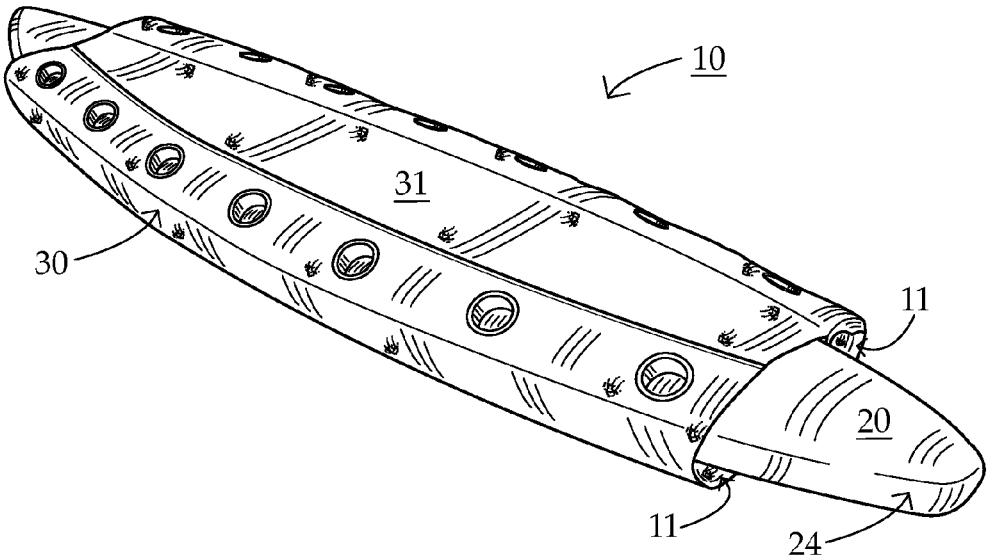
FIG. 1 depicts a top perspective view of an embodiment of the invention.
Figure 2:
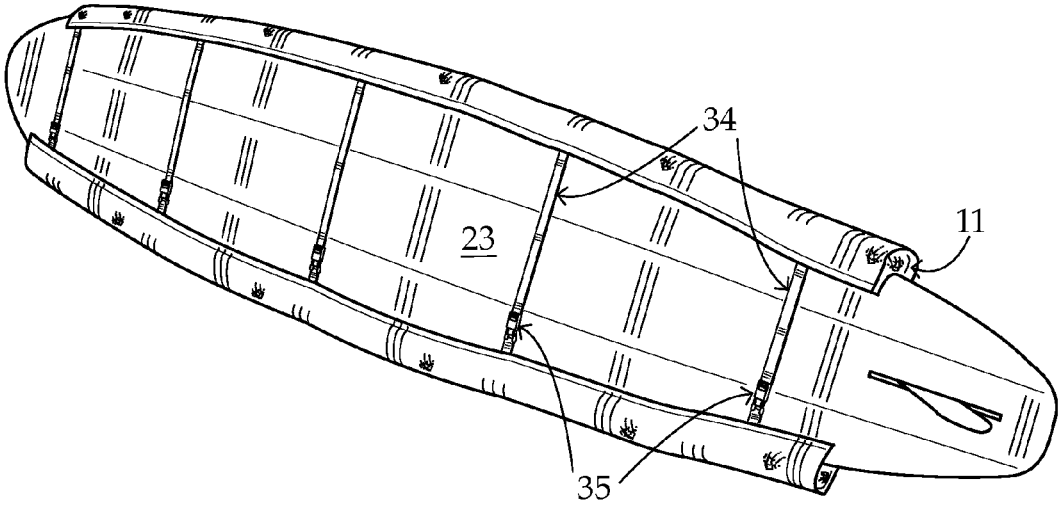
FIG. 2 depicts a bottom view of an embodiment of the invention.

Referring to FIG. 1, flotation system 10 includes conventional recreational board 20 outfitted with elongated substrates 11 along perimeter 24 of board 20, and fastening member 30 holding elongated substrates in position. As used herein, "recreational board" can refer to a variety of floating vessels including SUPs, surfboards, and the like, and it should be understood that the invention is not limited in any way to SUPs. In the embodiment of FIGS. 1 and 2, fastening member 30 includes sheath 31, which is preferably constructed of a resilient textile, with belts 34 and buckles 35 that connect on planar bottom 23 of board. While webbing belts and snap together buckles are preferred, other fastening means are also within the scope of this invention. In this manner elongated substrates 11 are held taut to the perimeter of recreational board 20.

Figure 3:
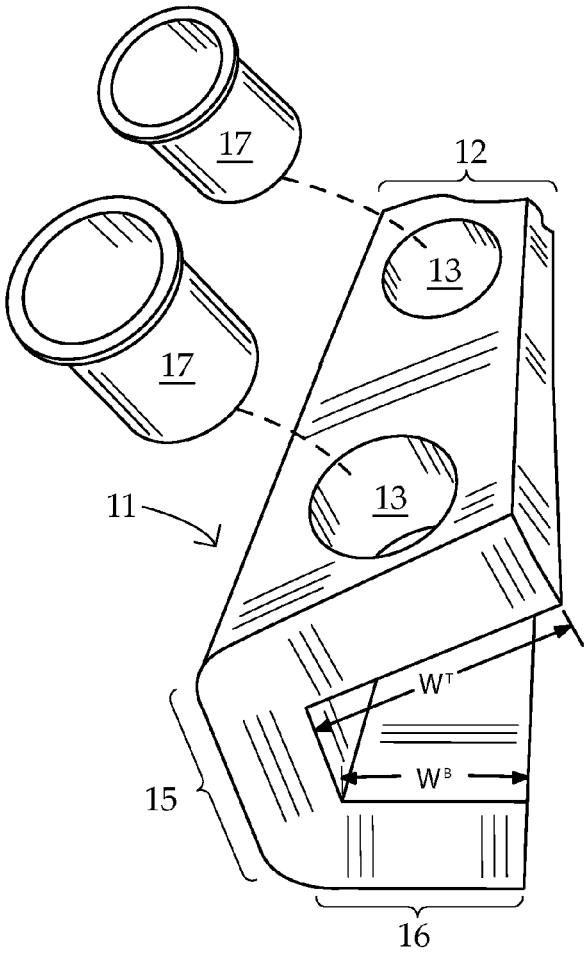
FIG. 3 depicts a side perspective view of an elongated substrate of the invention.
Figure 9:
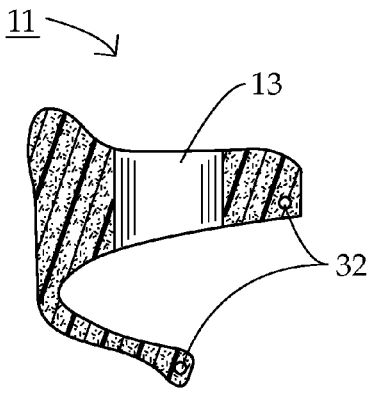
FIG. 9 depicts a cross-sectional view of an alternative embodiment of an elongated substrate.
Figure 10:
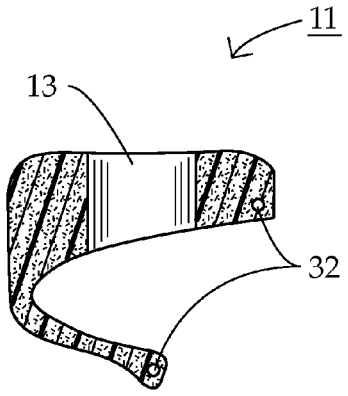
FIG. 10 depicts a cross-sectional view of an alternative embodiment of an elongated substrate.
Figure 11:
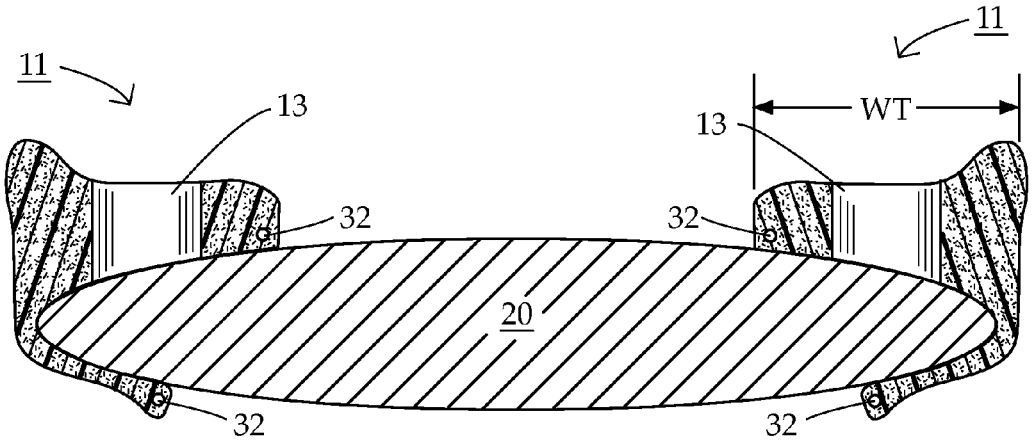
FIG. 11 depicts a cross sectional view of an alternative embodiment of FIG. 9 taken along FIG. 7.
Figure 12:
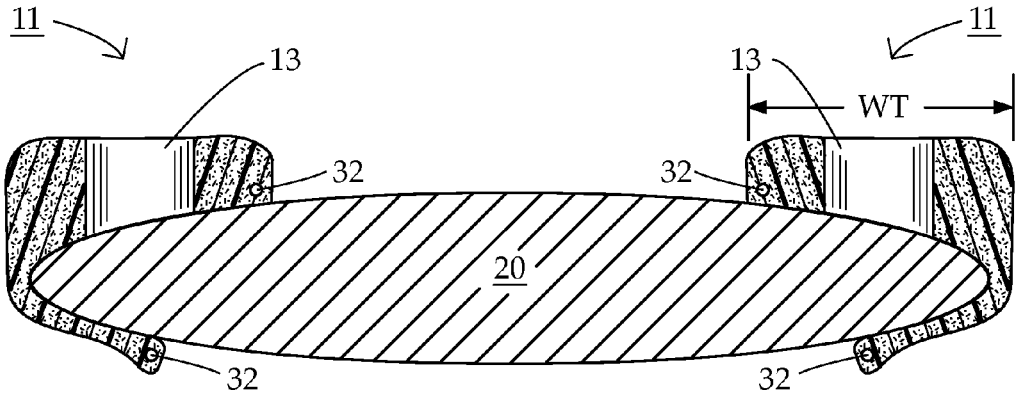
FIG. 12 depicts a cross sectional view of an alternative embodiment of FIG. 10 taken along FIG. 7.

FIG. 3 depicts a perspective side view of preferred elongated substrate 11. It generally includes top portion 12, side portion 15, and bottom portion 16, with those three sides defining longitudinal channel 14. Longitudinal channel 14 releaseably receives perimeter 24 of recreational board 20. The width of the top portion $W^T$, is preferably greater than the width of the bottom portion $W^B$. Top portion 12 preferably defines a plurality of cup holder apertures 13, and optionally includes a plurality of removable cup holder inserts 17. While the embodiment of FIG. 3 depicts a shape having angular vertices and substantially planar sides, it should be understood that a variety of sizes and shapes could be employed, so long as they releaseably engaged with the board's perimeter. FIGS. 9 and 10 set forth examples of alternative shapes for elongated substrate 11.

It is preferred that top portion 12 has a thickness of 5 cm to 7 cm, side portion 15 has a thickness of 4 cm to 5 cm, and bottom portion 16 has a thickness of 4 cm to 6 cm. It is preferred that top portion 12 has a width of 17.5 cm to 19 cm, side portion 15 has a width of 10 cm to 15 cm, and bottom portion 16 has a width of 15 cm to 18 cm.

Figure 4:
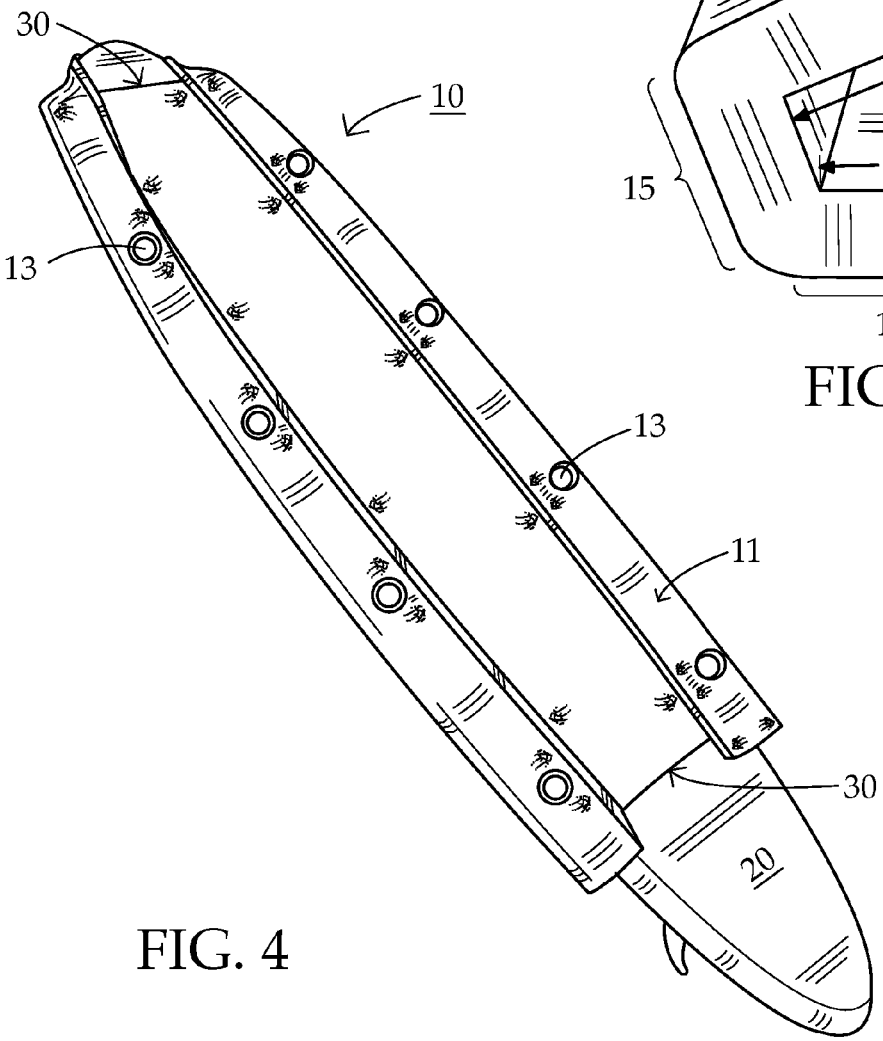
FIG. 4 depicts a top perspective view of an alternative embodiment of the invention.
Figure 5:
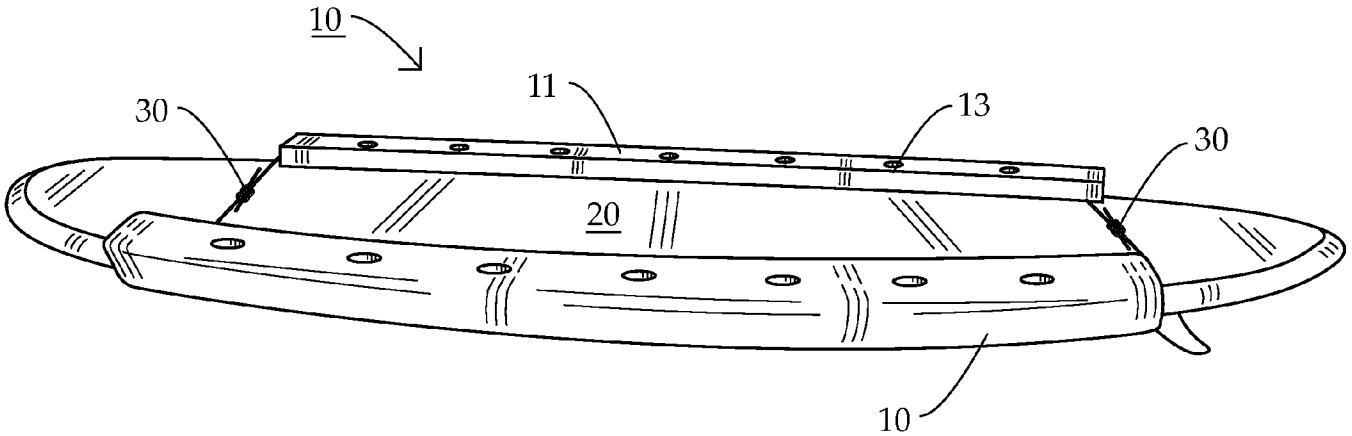
FIG. 5 depicts a side perspective view of an alternative embodiment of the invention.
Figure 6:
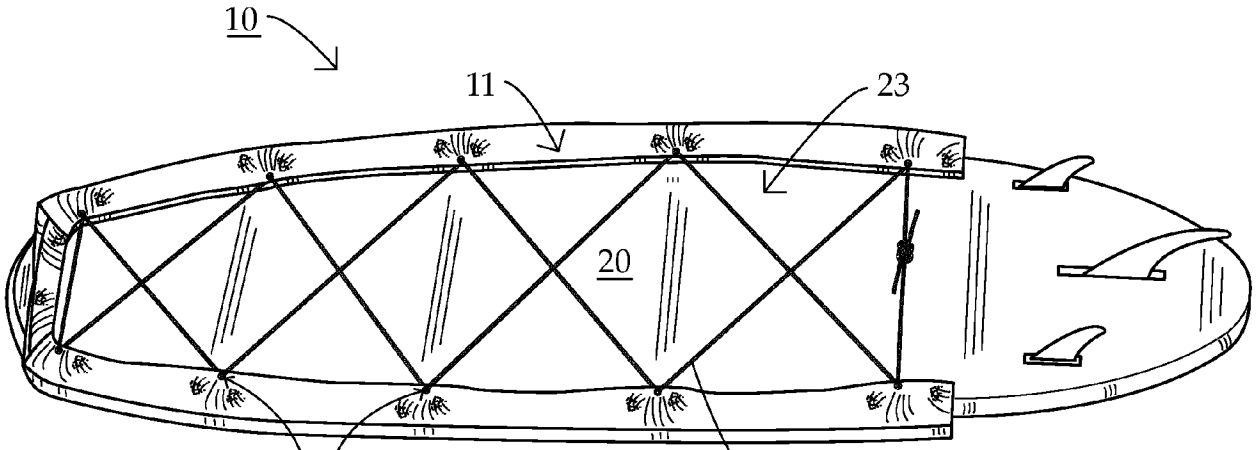
FIG. 6 depicts a bottom perspective view of an alternative embodiment of the invention.
Figure 7:
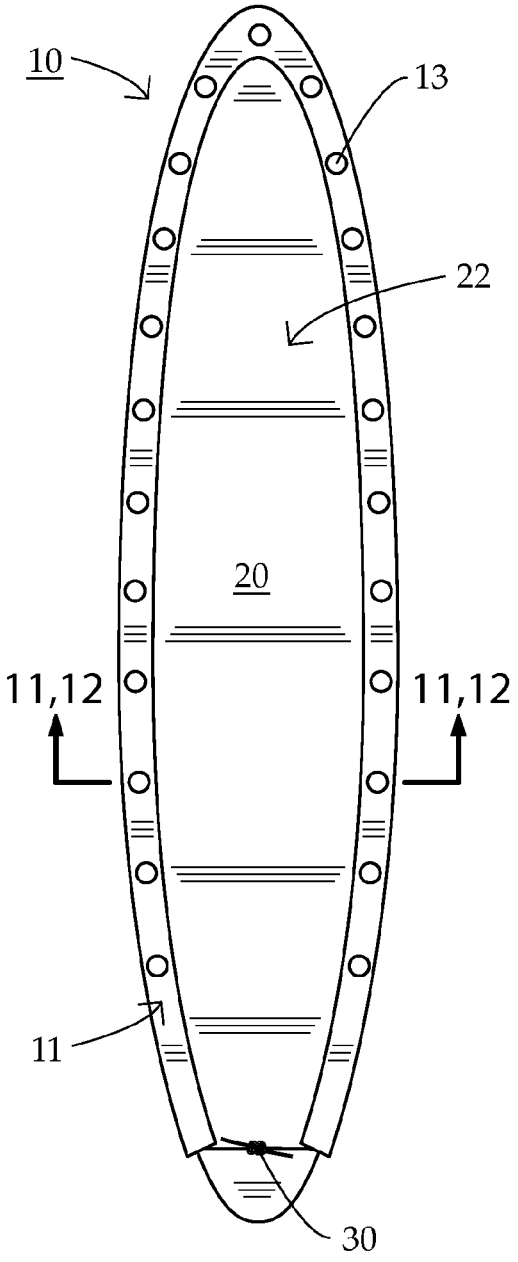
FIG. 7 depicts a top view of an alternative embodiment of the invention.
Figure 8:
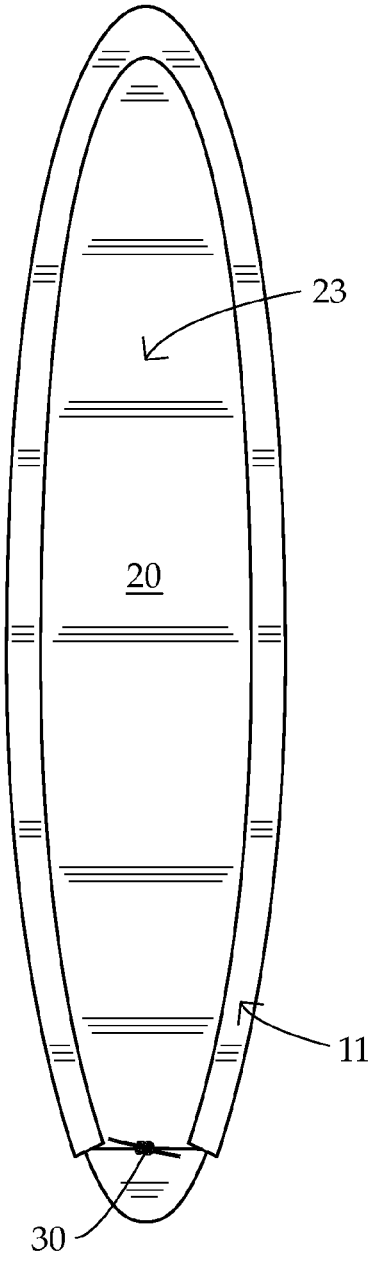
FIG. 8 depicts a bottom view of an alternative embodiment of the invention.

Elongated substrate 11 can be connected to recreational board 20 in a variety of ways. By way of example, FIGS. 4 and 5 depict embodiments whereby fastening member 30 is a tying or cinching means, such as rope or elastomeric rope. As shown in FIG. 6, fastening member may be in crisscross orientation on underside of board 20, with channels 32 defined by elongated substrate 11 slideably receiving fastening member 30. Alternatively, as suggested in FIGS. 7 and 8, fastening member 30 may run longitudinally along length of elongated substrate 11, and be tied off on planar top 22 of the board (FIG. 7) and planar bottom 23 of the board (FIG. 8). In this embodiment it is preferred that channels 32, as shown in FIGS. 9 and 10, run longitudinally along the length of the substrate. Although not shown in the figures, channel sleeve 33, such as an elongated tube, may line channels 32 so as to provide additional strength.

It is desirable that elongated substrate 11 covers at least 50% of the perimeter of the board, with coverage preferably being a mirror image relative to the longitudinal midline of the board so as to enhance stability. It is preferred that the elongated substrate is engaged with between 80% and 100% of the perimeter. It is also desirable that the elongated substrate floats in water, having an approximate density between 0.0114 gm/cm$^3$ and 0.032 gm/cm$^3$. One example of a suitable material is closed cell foam "Polyplank" manufactured by Pregis Corp. of Deerfield, Ill.

Cup holders 13 preferably extend through the entire height of top portion 12, and are preferably each a cylindrical aperture defined by elongated substrate 11, and having a diameter between 7.5 cm and 10 cm. Cup holder inserts 17 are preferably constructed of plastic, such as the rigid members used in some drink coozies.

In use, one would enhance a recreational board by positioning an elongated substrate around at least 50% of a recreational board, and securing the elongated substrate to the board with a fastening member. The fastening member may be a tying means such as a rope threaded through channels of the elongated substrate. Alternatively, the fastening member may be a sleeve that substantially covers the top and perimeter of the board, and has a fastening means such as buckles and straps for securing on the underside of the recreational board. The enhanced recreational board is then ready for use in the normal manner, except it floats better, is more stable, and securely holds beverages and other items.

It should be understood, of course, that the foregoing relates to exemplary embodiments of the invention and that modifications may be made without departing from the spirit and scope of the invention as set forth in the following claims. By way of example, it is possible to use the device with a variety of recreational boards, including lumber such as sheets of plywood and board planks, in order to create a floating bar. It should also be understood that ranges of values set forth inherently include those values, as well as all increments between.

What is claimed is:

1. A flotation system for use with a recreational board, said flotation system including:

a. An elongated substrate having a density between 0.014 gm/cm$^3$ and less than 1 gm/cm$^3$, said substrate consisting of a top portion, a side portion and a bottom portion, said portions defining a longitudinal open channel, said substrate also defining a plurality of cylindrical apertures that completely traverse said substrate, said apertures having a diameter between 7.5 cm and 10 cm; and b. A fastening member engageable with said top portion and said bottom portion of said substrate.

2. The flotation system of claim 1 wherein the width of said top surface is greater than the width of said bottom surface.

3. The flotation system of claim 1 further including at least one removable sleeve, each of said sleeves engaged with a cylindrical aperture.

4. The flotation system of claim 1 wherein said top portion and said bottom portion includes an attachment site, said fastening member engaged with said attachment site.

5. The flotation system of claim 4 wherein said attachment site is defined by said substrate.

6. An enhanced recreational board including:

a. A recreational board having a substantially planar top, a substantially planar bottom, and a perimeter;

b. An elongated substrate defining a longitudinal open channel, and also defining a plurality of cylindrical apertures that completely traverse said substrate, said apertures having a diameter between 7.5 cm and 10 cm said substrate engaged with between 80% and 100% of said perimeter; and c. A fastening member removably securing said substrate to said recreational board.

7. The enhanced recreational board of claim 6 wherein said recreational board is a stand up paddle board.

8. The enhanced recreational board of claim 6 wherein said substrate consists of a top portion, a side portion and a bottom portion, said portions defining a said channel.

9. The enhanced recreational board of claim 8 wherein said perimeter is engaged with said channel.

10. The enhanced recreational board of claim 6 wherein said fastening member includes an elastomeric connector.

11. The enhanced recreational board of claim 6 wherein said fastening member includes a sheath.

12. The enhanced recreational board of claim 11 wherein said fastening member further includes a plurality of webbing segments.

13. The enhanced recreational board of claim 12 wherein said plurality of webbing segments each terminate in a locking mechanism.

14. A method of converting a recreational board into an enhanced recreational board including the steps of:

a. Positioning the longitudinal open channel an elongated substrate around greater than or equal to 50% of the perimeter of a recreational board, wherein said substrate defines a plurality of cylindrical apertures that completely traverse said substrate, said apertures having a diameter between 7.5 cm and 10 cm said substrate; and b. Securing said substrate to said recreational board using a fastening member.

15. The method of claim 14 wherein said step of securing said substrate includes the step of tightening an elastomeric member.

16. The method of claim 14 wherein said step of securing said substrate includes the step of engaging mating sections of a locking mechanism.

* * * * *